United States Patent [19]

Bertagni

[11] Patent Number: 4,997,058

[45] Date of Patent: Mar. 5, 1991

[54] SOUND TRANSDUCER

[76] Inventor: Jose J. Bertagni, 39 Seabrook Cove, Newport Beach, Calif. 92660

[21] Appl. No.: 416,019

[22] Filed: Oct. 2, 1989

[51] Int. Cl.[5] ..... G10K 13/00

[52] U.S. Cl. ..... 181/166; 181/144; 181/164; 181/171; 181/173; 381/186; 381/188; 381/203; 381/205

[58] Field of Search ..... 181/163–166, 181/171–174, 144; 381/182, 186, 203, 205, 188

[56] References Cited

U.S. PATENT DOCUMENTS

| | | | |
|---|---|---|---|
| 1,751,356 | 3/1930 | Pinkler | 181/164 |
| 3,509,290 | 4/1970 | Mochida et al. | 181/164 X |
| 3,596,733 | 8/1971 | Bertagni | 381/158 |
| 3,722,617 | 3/1973 | Bertagni | 181/174 |
| 3,767,005 | 10/1973 | Bertagni | 181/174 X |
| 3,779,336 | 12/1974 | Bertagni | 181/174 |
| 3,792,394 | 2/1974 | Bertagni | 381/194 X |
| 3,801,943 | 4/1974 | Bertagni | 381/158 |
| 4,003,449 | 1/1977 | Bertagni | 181/173 |
| 4,184,563 | 1/1980 | Bertagni | 181/171 |
| 4,257,325 | 3/1981 | Bertagni | 181/172 |
| 4,315,112 | 2/1982 | Hofer | 181/165 X |
| 4,847,908 | 7/1989 | Nieuwendijk et al. | 181/165 X |

*Primary Examiner*—Benjamin R. Fuller
*Attorney, Agent, or Firm*—Price, Gess & Ubell

[57] ABSTRACT

An improved flat sound transducer including a planar diaphragm having at least one region suited for reproduction of low frequencies and one region suited for reproduction of high frequencies wherein the frame of the flat sound transducer is used to sandwich a foam strip between the frame and the diaphragm in order to dampen low frequency vibrations and substantially isolate the high frequency region from the large amplitude low frequency vibrations while still allowing high frequency vibrations to emanate from the entire sound transducer diaphragm. The dampening strip may used with either a metallic frame or with a unitary plastic frame. A high frequency enhancement coating may be used to increase the frequency response in the high frequency region of the diaphragm.

19 Claims, 7 Drawing Sheets

SOUND TRANSDUCER

BACKGROUND OF THE INVENTION

1. Field of the Invention

This invention generally relates to sound transducers. More particularly, the present invention relates to substantially planar sound transducers also known as flat loud speakers.

2. Description of the Prior Art

Prior art flat loud speakers typically include a diaphragm that is constructed from a substantially planar panel of molded styrofoam or other suitable material. The diaphragm is usually suspended from a support frame by a layer of foam rubber or the like. The front side of the diaphragm is generally smooth while the back side or frame side of the diaphragm has various shapes and channels molded therein so as to divide the panel into a plurality of regions, each region being suited for reproduction of sound in a particular frequency range. A plurality of cross members are attached to the support frame and at least one electromagnetic driver is attached thereto so that its electromagnetic coil is situated above a corresponding hammer that is attached to a predetermined region on the back side of the diaphragm.

Typical prior art flat loud speakers, methods of manufacturing the same, and components thereof are disclosed in the following prior U.S. Pat. Nos. issued to the herein inventor: 4,257,325; 4,184,563; 4,003,449; 3,801,943; 3,792,394; 3,779,336; 3,767,005; 3,722,617; and 3,596,733. The foregoing patents are hereby incorporated by reference as if fully set forth herein.

In ordinary speaker systems, it is generally necessary to have at least one electromagnetic driver and conical diaphragm that are suited for low frequency signals and a separate electromagnetic driver and diaphragm that are suited for high frequency signals. Frequently, a driver and diaphragm that operate best in the midrange are also employed.

In ordinary paper cone sound systems that typically use paper cone-shaped diaphragms, a diaphragm used for producing low frequencies is not physically coupled with a diaphragm used for producing high frequencies. There is little concern with respect to interference or intermodulation between the low frequency vibrations and the high frequency vibrations where separate diaphragms are uses so that there is no physical coupling between the diaphragms.

Flat planar speakers were developed in part to closely approximate reality by reproducing all frequencies in the sound spectrum from a single source diaphragm. However, because a flat loud speaker is constructed from a substantially planar diaphragm having at least one unitary smooth surface, the various regions of the diaphragm are physically coupled to one another by the common surface of the diaphragm.

One problem that has been experienced with the prior art flat loud speakers is interference or intermodulation between the low frequency and high frequency regions of the speaker.

Because of the physical coupling of the various sound reproduction regions by the common surface, it becomes necessary to isolate and limit the low frequency sound reproduction regions of the diaphragm so that the large low frequency vibrations do not unduly interfere or intermodulate with the high frequency sound reproduction regions. However, while desirable to isolate the low frequencies from the high frequency regions, it is still desirable to avoid directivity and increase the omnidirectional production of high frequency by allowing the high frequencies to emanate from the overall surface of the flat speaker system.

In the prior art flat loud speakers, limited isolation or dampening was partially accomplished by surrounding the high and low frequency sound reproduction regions with endless grooves that extend inward from the back side of the diaphragm. While such isolation grooves help solve the interference problem, the high frequency sound reproduction regions still continue to experience detrimental interference from low frequency vibrations that are transmitted through the common planar surface of the diaphragm.

Another problem that has been experienced with prior art flat loud speakers relates to the limited range of frequency reproduction that results from the economic desirability of selecting a unitary diaphragm material that represents a less than ideal compromise between high and low frequency reproduction.

SUMMARY OF THE INVENTION

It is an object of the present invention to improve the sound reproduction qualities of flat loud speakers by isolating the low frequency vibration from the high frequency regions while still allowing the high frequency vibrations to travel into the low frequency regions and thereby emanate from the entire surface of the speaker system.

It is a further object of the present invention to extend the frequency response in a high frequency region of the diaphragm;

It is a further object of the present invention to extend the overall frequency response in a flat loud speaker that is simple and cost efficient to manufacture; and It is a further object of the present invention to protect the diaphragm from damaging heat generated by the driving coils while providing added control of the frequency response of the protected region.

The present invention achieves the above objects by providing an improved flat sound transducer having a substantially unilateral dampening means that dampens and isolates low frequency vibrations to a low frequency region while still allowing high frequency vibrations to emanate from the entire sound transducer diaphragm. In addition, the present invention provides a high frequency enhancement means that increases the high frequency response in a high frequency region such that the density of the overall diaphragm material may be lowered and the low frequency response may also be increased.

DETAILED DESCRIPTION OF THE PREFERRED EMBODIMENT

The following description is provided to enable any person skilled in the art of sound transducers to make and use the invention and sets forth the best mode contemplated by the inventor for carrying out the invention. However, various modifications will remain readily apparent to those skilled in these arts, since the generic principles of the present invention have been defined herein specifically to provide a relatively economical and practical sound transducer.

Figure 10:
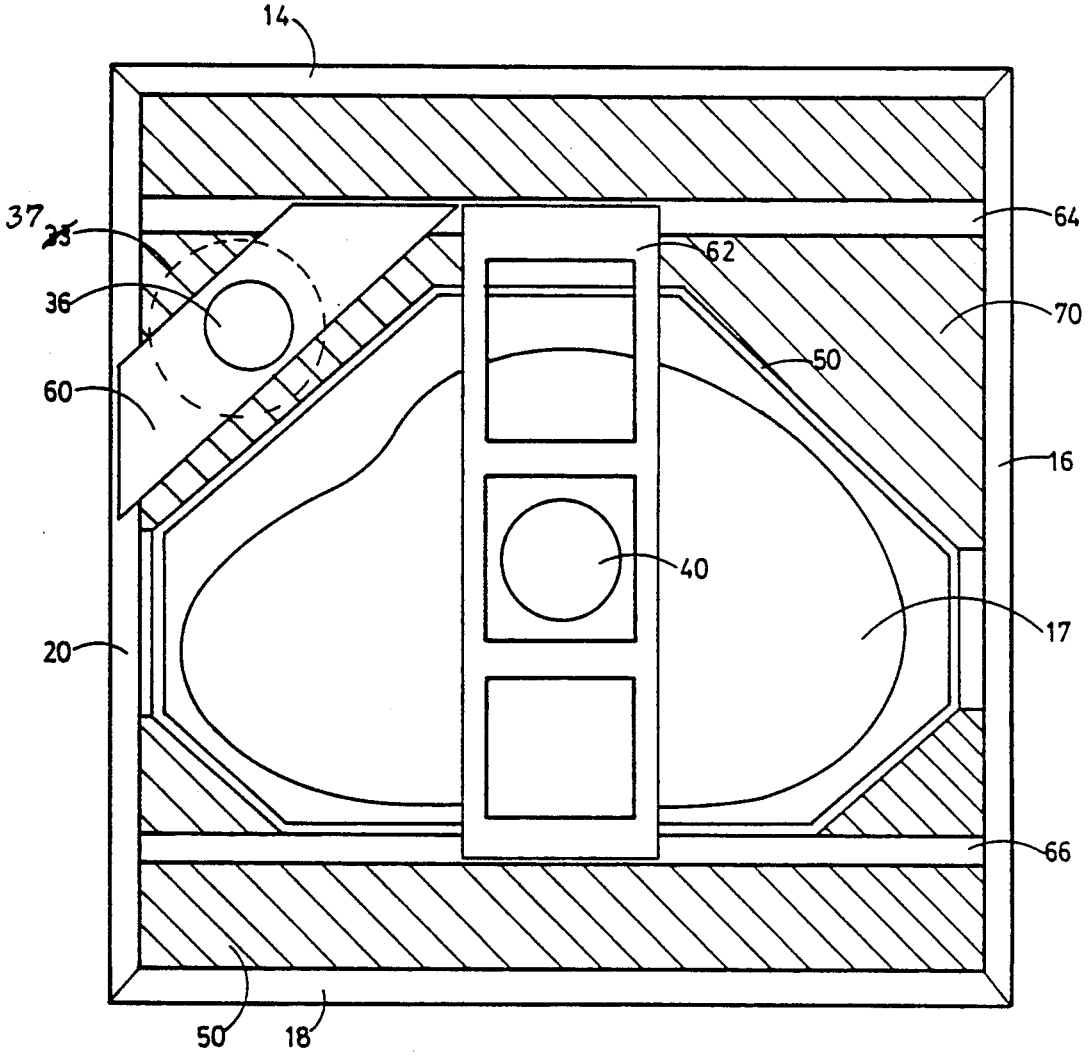
FIG. 10 is a overhead plan view of a prior art flat loud speaker.

A prior art flat loud speaker is depicted in FIG. 10. As shown, the prior art flat loud speaker is comprised of a rectangular frame structure consisting of four outer frame members 14, 16, 18, 20 and two cross members 64 and 66 which serve only to support the driver supports 60 and 62.

A basic goal of flat loud speakers is to closely approximate reality by providing a unitary source of sound independent of frequency. In order to achieve this goal, the prior art flat loud speaker in FIG. 10 employs a planar diaphragm 70 having a low frequency region 17 and a high frequency region 37. The low frequency region 17 is physically coupled to the high frequency region 37 by the common front surface 13 of the planar diaphragm. Note also that the prior art high frequency region 37 is immediately adjacent to the low frequency region 17. The prior art location of the high frequency region 37 is undesirable because the physical proximity contributes to undesirable physical coupling. Moreover, such location is inefficient and costly with respect to manufacturing because a separate driver support 60 must be used to support the high frequency driver 36 above the high frequency region 37.

Although it is desirable to provide a single planar source of sound, the relatively intense low frequency vibrations may interfere with sound reproduction in the high frequency sound region by propagating through the common surface 13 of the planar diaphragm 12. Although the prior art flat loud speakers have attempted to isolate the low frequency region with an endless channel 50, such detrimental propagation continues to be a problem in the industry.

This inventor has developed an improved frame structure which substantially solves the above detrimental propagation problem while simultaneously providing an improved, simpler to construct, and more cost effective frame structure.

Figure 1:
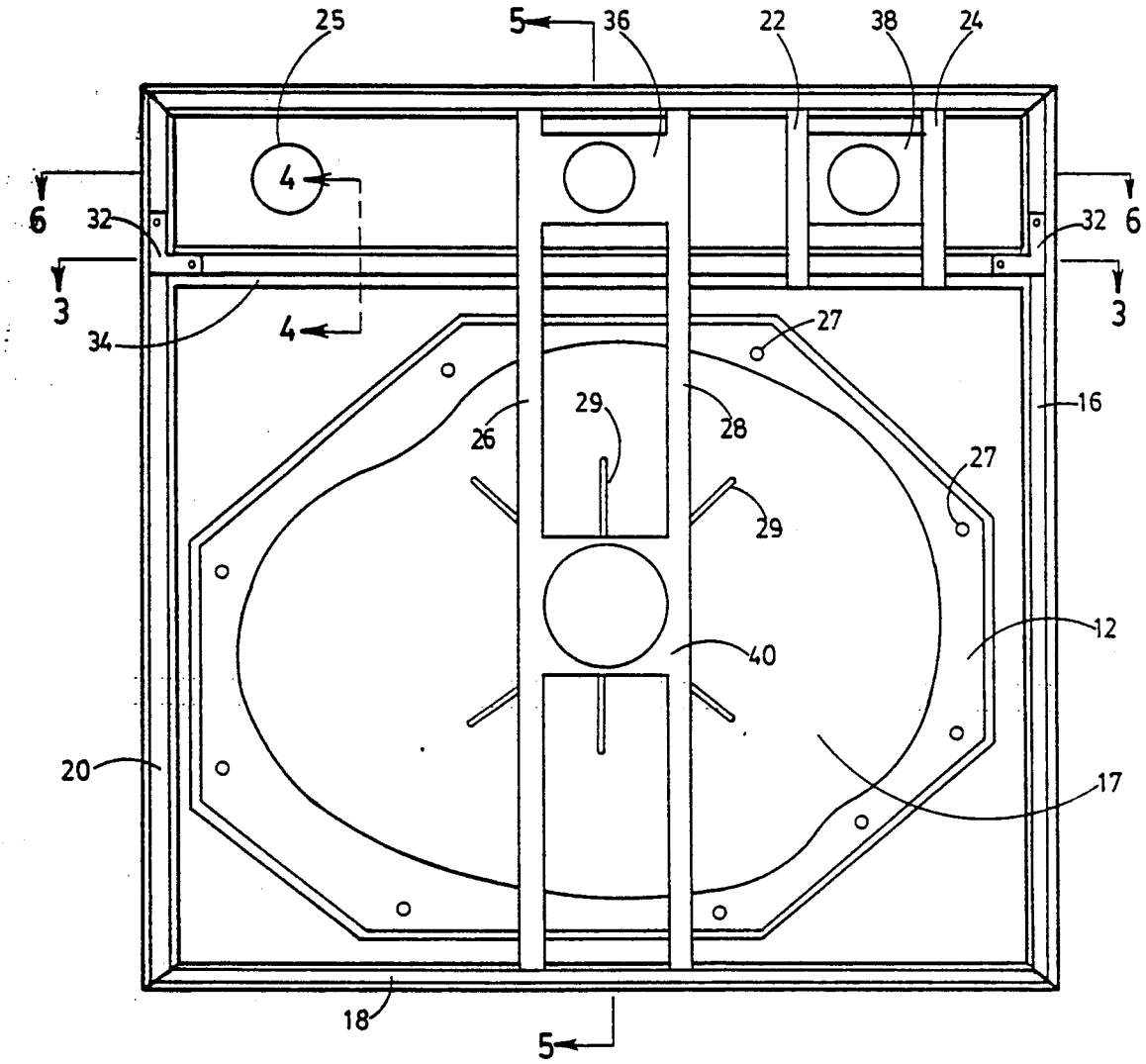
FIG. 1 is an overhead plan view of the back side of a first embodiment of a frame of a flat sound transducer according to the present invention.
Figure 2:
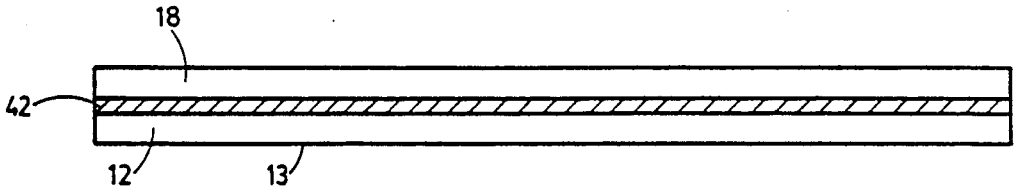
FIG. 2 is a side plan view of the flat sound transducer of FIG. 1.

With reference to FIGS. 1 and 2, it can readily be seen that a flat loud speaker according to the present invention is comprised of a flat diaphragm 12 that is movably suspended by a cushioning strip 42 from frame members 14, 16, 18, and 20. In a preferred embodiment, the frame members 14, 16, 18, 20 are aluminum and the cushioning strip 42 is foam rubber. The planar diaphragm 12 has a substantially flat front surface 13 and a back surface whereupon various sound reproduction regions 17, 19 are defined.

Figure 5:
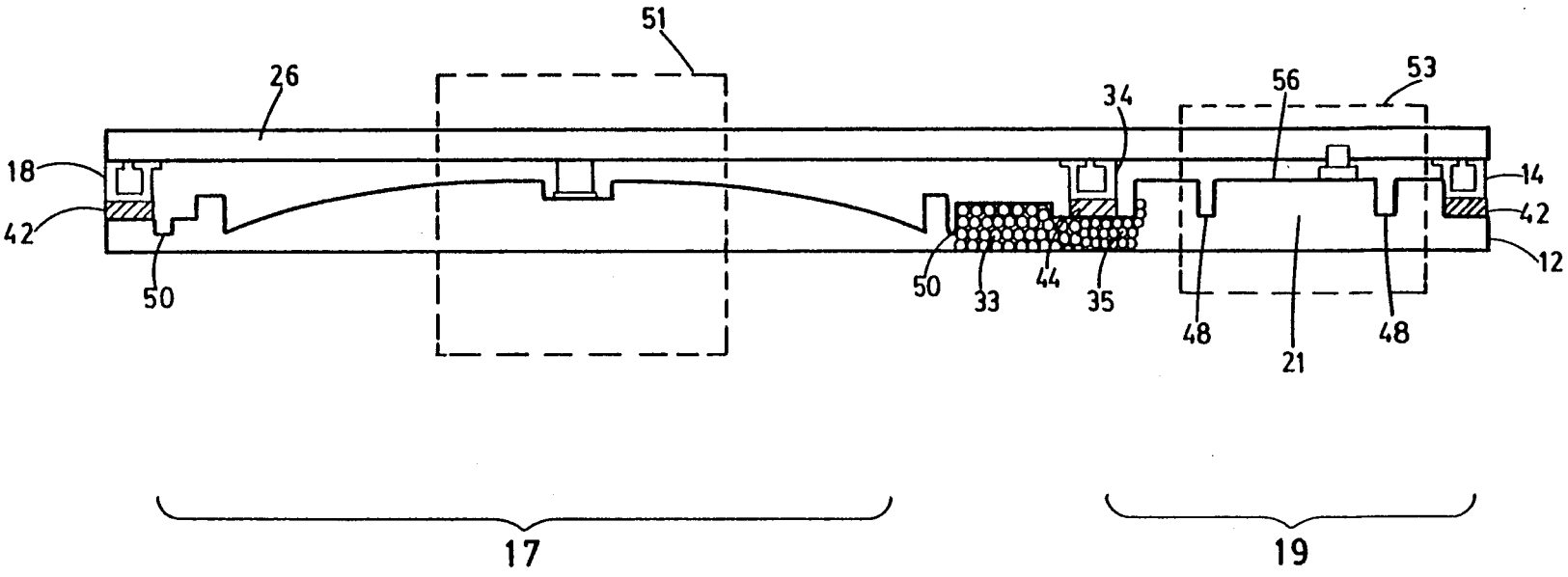
FIG. 5 is a cross sectional view of the flat sound transducer taken along line 5—5 of FIG. 1.

As shown in FIGS. 1 and 5, an irregular shaped low frequency region 17 is defined by an endless channel 50 and a rectangular high frequency region 19 is defined by three frame members 14, 16, 20 and cross member 34.

It is widely known in the art that the frequency response of a region on the diaphragm is changed by varying the material density or dimensions (thickness and/or diameter) of the region of the planar diaphragm that is reproducing the sound. Low frequencies are best produced by a large, low density region and high frequencies are best produced by a small, high density region.

By employing these principals, a flat diaphragm may be manufactured with various regions that are individually tailored for particular frequency ranges. For example, a low frequency region (woofer) may be produced in a flat diaphragm by defining a relatively soft and thin area of large diameter and a high frequency region (tweeter) may be produced by defining a relatively hard and thick area of small diameter.

In addition, holes 27 are provided about the perimeter of the low frequency region. The frequency response of the low frequency region may be adjusted by inserting additional mass (such as ball bearings or the like) into the holes 27. Slots 29 are included for the purpose of providing additional flexibility to the low frequency region.

The diaphragms are generally manufactured in a single operation from a material of uniform density (i.e. blown polystyrene foam). Although the relative thickness and diameter of the regions can be easily varied, the use of a material of uniform density precludes varying the relative density of the various regions.

This manufacturing limitation forces an undesirable compromise in the production of prior art flat loud speakers. In particular, a compromise density for the diaphragm material must be selected to achieve a satisfactory low end response while also attempting to maintain a satisfactory high end response. Because of this compromise situation, there is still considerable need to improve the sound reproduction quality of flat loud speakers over the entire audio range.

In accordance with the known principle that the frequency range is a function of density, diameter, and thickness, the low frequency region 17 is of larger diameter and thinner than the high frequency region 19. As shown in FIG. 5, the high frequency response may be further enhanced by using an endless channel 48 of circular shape in order to define an even smaller diameter subregion 21 within the rectangular high frequency region 19.

In order to reproduce sound based on electrical signals, the flat loud speaker 10 further comprises two electromagnetic drivers 36, 40. The low frequency electromagnetic driver 40 is supported over the low frequency region 17 by a pair of cross members 26, 28. The high frequency electromagnetic driver 36 is beneficially supported over the high frequency region 19 (and subregion 21) by the same pair of cross members 26, 28. Hence, a separate driver support 60 (FIG. 10) is no longer required. As shown in FIG. 1, one or more additional electromagnetic drivers 38 (only one is shown) may be provided to drive other subregions of varying frequency response in the high frequency region 19. Such additional drivers would likely have different masses in order to assist in providing the desired frequency response. For example, a piezo-electric driver may be employed to assist in the reproduction of very high frequency signals.

Figure 6:
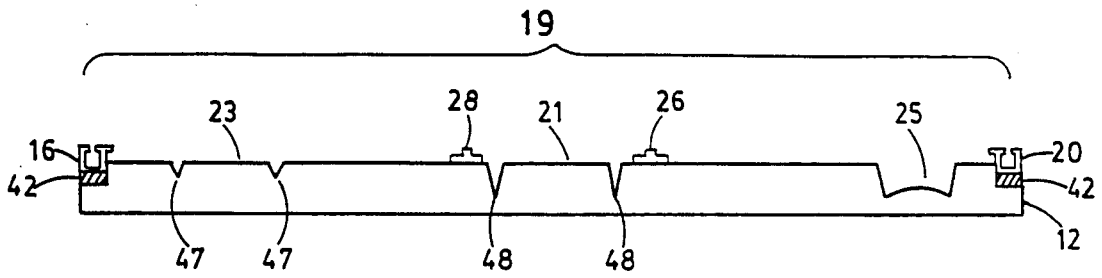
FIG. 6 is a cross sectional view of the low frequency region and its various subregions.

FIG. 6 is provided to further illustrate the high frequency region 19 shown if FIGS. 1 and 5. FIG. 6 is a cross sectional view of FIG. 1 taken along lines 6—6. As shown in FIG. 6, the high frequency region 19 may be further divided into a plurality of high frequency subregions 21, 23, 25. Each of the subregions 21, 23, 25 may be individually tailored for production of a particular frequency range by varying the depth or width of the subregion's respective annular channel 47, 48. In addition, subregion 25 may be in the form of an annular recess 25 to accommodate a piezo-electric driver.

Figure 3:
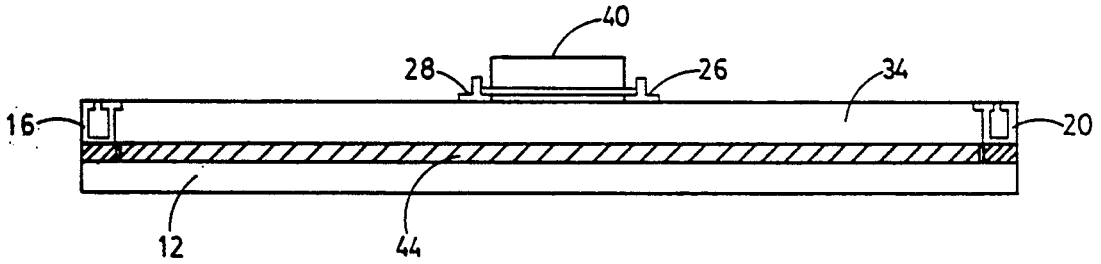
FIG. 3 is a cross sectional view of a dampening means employed in the flat sound transducer taken along line 3—3 of FIG. 1.
Figure 4:
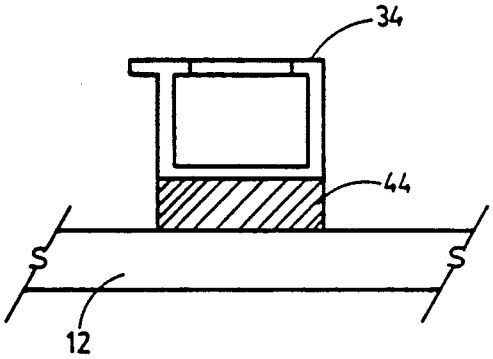
FIG. 4 is a cross sectional view of the dampening means employed in the flat sound transducer taken along line 4—4 of FIG. 1.

The actual dampening means will now be described with reference to FIGS. 1, 3, and 4. Referring to FIG. 1, a cross member 34 is provided between the two outer member 16, 20 with fasteners 32. The actual fastening method used may of course differ from that depicted in FIG. 1. As shown in FIGS. 3 and 4, cross member 34 is used in conjunction with a dampening strip 44 that is sandwiched between the cross member 34 and the planar diaphragm 12. A dampening means comprised of the cross member 34 and the dampening strip 44 essentially operates as a physical high-pass filter in that the detrimental low frequency vibrations are prevented from travelling from the low frequency region 17 into the high frequency region 19 while the high frequency vibrations are permitted to travel from the high frequency region 19 into the low frequency region 17.

Figure 8:
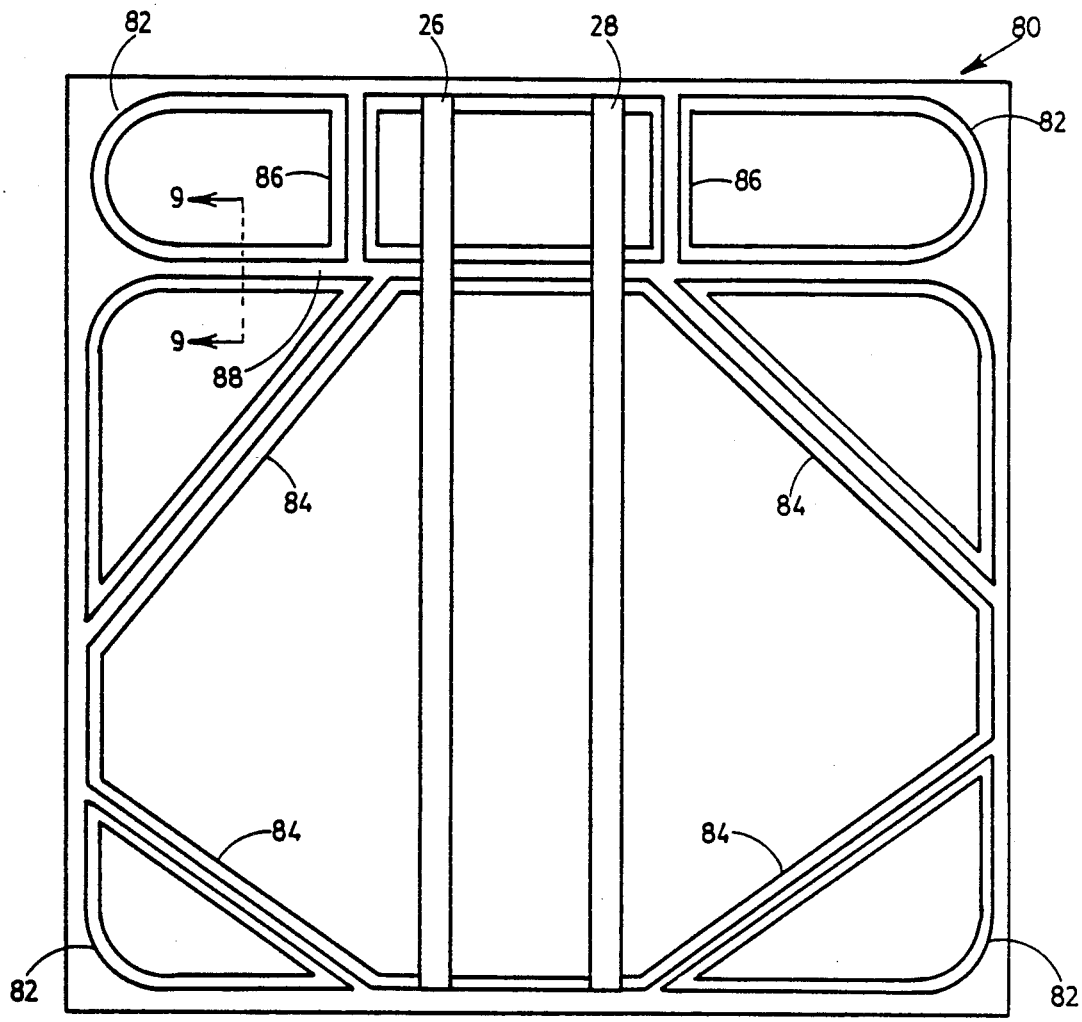
FIG. 8 is an overhead plan view of the back side of a second embodiment of a frame of a flat sound transducer according to the present invention.
Figure 9:
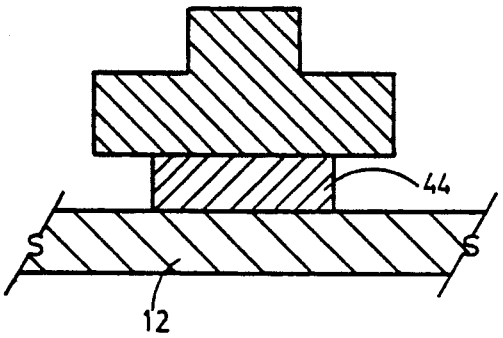
FIG. 9 is a cross sectional view of the dampening means employed in the flat sound transducer taken along line 9—9 of FIG. 9.

An alternative frame structure is illustrated by FIGS. 8 and 9. FIG. 8 illustrates a frame 80 that is constructed of a light cellular material similar to that used in the construction of the diaphragm 12. Although the frame 80 is constructed of a similar material, the material used would be of higher density in order to provide the needed strength. As shown in FIG. 9, the frame 80 has a T-shaped cross section to assist in strength and rigidity. The strength of the frame 80 may be further improved by including wide radius curves 82 in the corners and cross members 84 and 86. Note that a cross member 88 of the unitary frame 80 is used as a substitute for the metallic cross member (reference number 34 in FIG. 1) to sandwich the damping strip 44 between the frame 80 and the diaphragm 12. Note that metallic members 26 and 28 are still employed to act as heat sinks for the electromagnetic drivers (not shown). The plastic frame 80 is preferred over the typically metallic frame shown in FIG. 1 because it is relatively easy to manufacturer, easy to assemble, and much lighter.

Figure 7:
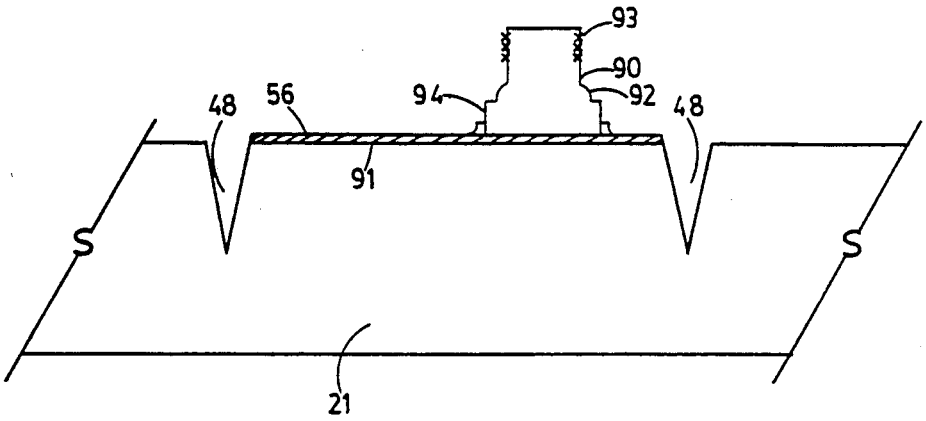
FIG. 7 is a detailed cross sectional view of a high frequency region taken along line 7—7 of FIG. 1.

Referring to FIGS. 5 and 7, note that the high frequency subregion 21 may beneficially include a hard surface 56 for extending the high end frequency response. In a preferred embodiment, a coating or resin, such as a lacquer or the like, is applied as a liquid and allowed to dry to form the hard surface 56. However, it is not necessary that the hard surface actually be applied as a liquid coating since a thin disc of aluminum or other hard material could be easily substituted.

The hard surface 56 provides an extended and more efficient high frequency sound production and selectively raises the frequency response of the speaker in the high frequency areas. Without the hard surface 56, the contact area between the hammer 36*a* and the high frequency subregion 21 is quite small. Hence, much of the energy provided by the high frequency hammer is dissipated in compression of the material directly beneath the hammer 36*a*. The sound reproduction is more efficient because the hard surface 56 ensures a more even distribution of the energy provided to the surface of the subregion 21.

By selectively extending the frequency response in selected high frequency subregions of the planar diaphragm 12, it is possible to provide a flat loud speaker having an extended high frequency response (in the coated subregion 21) and an extended low frequency response (in the low frequency region 17). This expansion of the frequency response on both sides of the spectrum is possible because the selective expansion of the high frequency regions allows for the planar diaphragm 12 to have a compromise density that leans toward low frequency sound production. Hence, the hard surface 56 allows both the low frequency and the high frequency ranges to be extended.

According to the present invention, in addition to expanding the high frequency response, a much more efficient transfer of energy may be achieved by including a hard surface 56 between the hammer assembly and the upper surface 91 of the subregion 21 as best shown in FIG. 7.

As described earlier, the frequency response of a region may be changed by varying density, diameter or thickness. FIG. 6 is a detailed view of the region in FIG. 5 designated by dashed line 53. Ordinarily, a hammer comprised of a tube 90 that is circumferentially wrapped with coils 93. When it is desired to adjust the frequency response of the region being driven with the hammer, the hammer may further include a dampening member 94 that is placed between the tube 90 and the high frequency subregion 21 of the planar diaphragm 12. In the prior art, the tube 90 and dampening member 94 are fastened directly to an upper surface 91 of the subregion 21.

The planar diaphragm is typically constructed of a relatively compressible material such as polystyrene. Hence, when the hammer is electromagnetically driven, much of the energy is dissipated in compressing that portion of the diaphragm that is immediately below the mounted position of the hammer. By including the hard surface 56, compression is less of a problem because the driving forces of the hammer assembly are spread out over a greater area. Hence, the energy delivered by the driving assembly may be more efficiently transferred to the planar diaphragm 12 rather than be lost to local compression of the subregion.

FIG. 5 further illustrates an alternative aspect of the present invention. Specifically, note that the low frequency region 17 and the high frequency region 19 may be constructed from material of differing densities. In manufacture, the high frequency region 19 would be constructed from a material 33 having a high density and the low frequency region 17 would be constructed from a material 35 having a relatively low density. A firm junction between between the materials 33, 35 and a unitary front face 13 may be provided by using a blown polystyrene foam operation with different materials. It is contemplated that materials of varying density could be used instead of or in addition to damping means 34.

While the above features of the present invention teach the construction, configuration and application for an improved sound transducer, it can be readily appreciated that it would be possible to deviate from the above embodiments of the present invention and, as will be readily understood by those skilled in the art, the invention is capable of many modifications and improvements within the scope thereof. Accordingly, it will be understood that the invention is not limited by the specific embodiments but only by the spirit and scope of the appended claims.

What I claim is:

1. An improved sound transducer that includes a substantially planar diaphragm having at least first and second sound producing regions thereon, each of said sound producing regions being physically suited for reproduction of a particular frequency range and which diaphragm is movably supported by a support frame, the improvement comprising:

a dampening means for isolating said first sound producing region from said second sound producing region, said dampening means supported by the support frame and contacting said diaphragm between the first and second sound producing regions of said diaphragm whereby frequencies produced in the second sound producing region of said diaphragm may be substantially isolated from the first sound producing region of said diaphragm.

2. The improved sound transducer of claim 1 wherein said dampening means is comprised of a solid member extending between opposite sides of the support frame.

3. The improved sound transducer of claim 2 wherein said support frame is constructed of a plurality of metallic members and wherein said dampening means is also a metallic member.

4. The improved sound transducer of claim 2 wherein said support frame is constructed of a plurality of plastic members and wherein said dampening means is also a plastic member.

5. The improved sound transducer of claim 2 wherein said support frame is a structure constructed of a cellular material and wherein said dampening means is a portion of the cellular unitary support frame.

6. The improved sound transducer of claim 2 wherein said dampening means further includes a dampening material located between said solid member and said diaphragm.

7. The improved sound transducer of claim 4 wherein said dampening material is foam rubber.

8. The improved sound transducer of claim 1 wherein said second sound producing region is divided into a plurality of sound producing subregions having a predetermined frequency response, each sound producing subregion being driven by a corresponding electromagnetic driver.

9. The improved sound transducer of claim 8 wherein the frequency responses of each sound producing subregion is a function of mass of a corresponding electromagnetic driver.

10. The improved sound transducer of claim 8 wherein the frequency response of each sound producing subregion is varied by varying an outside dimension of the sound producing subregion with an inset annular channel.

11. The improved sound transducer of claim 10 wherein the frequency response of each sound producing subregion is varied by varying a depth of the inset annular channel.

12. An improved sound transducer including a substantially planar diaphragm which has a plurality of sound producing regions thereon, each sound producing region being physically suited for reproduction of various frequency ranges, each sound producing region including a corresponding electromagnetic driver and a hammer connecting said electromagnetic driver to said sound producing region, and said diaphragm is movably supported by a support frame, the improvement comprising:

a layer of material being placed on a sound producing region of said diaphragm, said layer of material being sandwiched between said hammer and said sound producing region, and said layer of material being harder than said diaphragm such that energy applied to said sound producing region by said hammer is spread out over said sound producing region so as to increase a high frequency response of said sound producing region.

13. The improved sound transducer of claim 12 wherein said layer of material is placed on said area as a liquid coating and which layer of material subsequently hardens.

14. The improved sound transducer of claim 13 wherein said liquid coating is a resin.

15. The improved sound transducer of claim 13 wherein said liquid coating is a lacquer.

16. The improved sound transducer of claim 12 wherein said layer of material is a thin plate of solid material.

17. The improved sound transducer of claim 16 wherein said layer of material is a thin sheet of metal.

18. The improved sound transducer of claim 17 wherein said metal is aluminum.

19. The improved sound transducer of claim 12 wherein said sound producing region is circular in shape.

* * * * *